US005676249A

United States Patent [19]

DeProspero

[11] Patent Number: 5,676,249

[45] Date of Patent: Oct. 14, 1997

[54] DAMAGE-RESISTANT WALLPAPER PACKAGING

[75] Inventor: David A. DeProspero, Strongsville, Ohio

[73] Assignee: Imperial Wallcoverings, Inc., Beachwood, Ohio

[21] Appl. No.: 505,902

[22] Filed: Jul. 24, 1995

[51] Int. Cl.[6] ..... B65D 85/00

[52] U.S. Cl. ..... 206/388; 206/49; 206/495

[58] Field of Search ..... 206/321, 49, 388, 206/495, 702; 242/127

[56] References Cited

U.S. PATENT DOCUMENTS

| | | | |
|---|---|---|---|
| D. 23,134 | 3/1894 | DeLong . | |
| D. 119,152 | 2/1940 | Bender . | |
| D. 233,083 | 10/1974 | Rosa | D20/3 |
| D. 250,996 | 2/1979 | Glaser | D9/191 |
| D. 276,312 | 11/1984 | Lööf | D9/337 |
| D. 299,621 | 1/1989 | Kirk | D9/457 |
| D. 327,427 | 6/1992 | McCooey | D9/415 |
| 210,577 | 12/1878 | Taylor . | |
| 912,602 | 2/1909 | Nesbit . | |
| 926,876 | 7/1909 | Keel . | |
| 1,232,955 | 10/1917 | Moody . | |
| 1,319,681 | 10/1919 | Albrecht . | |
| 1,506,010 | 8/1924 | Lapin . | |
| 1,929,167 | 10/1933 | Goldsmith . | |
| 2,230,559 | 2/1941 | Cartier . | |
| 2,271,346 | 1/1942 | Rosenberger . | |
| 2,328,522 | 8/1943 | Yocum | 206/495 |
| 2,706,041 | 4/1955 | Tate | 206/79 |
| 2,839,185 | 6/1958 | Isaacs | 206/49 |
| 3,858,719 | 1/1975 | Isaacs | 206/49 |
| 4,161,075 | 7/1979 | Eubanks et al. | 206/388 |
| 4,219,140 | 8/1980 | Simonoff | 223/87 |
| 4,258,843 | 3/1981 | Wymer | 206/49 |
| 4,664,264 | 5/1987 | Kirk | 211/13 |
| 4,890,730 | 1/1990 | Kovac | 206/303 |

FOREIGN PATENT DOCUMENTS

| | | |
|---|---|---|
| 258294 | 4/1928 | Italy . |

*Primary Examiner*—David T. Fidei

*Attorney, Agent, or Firm*—Bell, Seltzer, Park & Gibson, P.A.

[57] ABSTRACT

A wallpaper display package permits vertical display of wallpaper without causing a crease or other damage to the wallpaper. The display package comprises a card having a generally planar body portion of substantially uniform thickness configured to receive an elongate wallpaper sheet wound thereon. A pair of opposing tabs are positioned on and project from respective sides of the body portion lower end. Each tab has an upper portion configured to prevent the wound wallpaper from sliding over the body portion lower end. A pair of opposing slots are provided in the body portion adjacent the upper portions of each tab. The slots prevent the formation of a crease in the wallpaper when displayed vertically.

13 Claims, 1 Drawing Sheet

DAMAGE-RESISTANT WALLPAPER PACKAGING

FIELD OF THE INVENTION

The present invention relates generally to packaging, and more particularly to packaging for wallpaper.

BACKGROUND OF THE INVENTION

Decorative wallpaper borders are becoming increasingly popular as a way to add atmosphere and color to a room. A wallpaper border is a relatively narrow strip of wallpaper, typically prepasted, having various decorative patterns and colors for accentuating existing colors and patterns within a room. Wallpaper borders are typically used along ceiling lines, chair rails, and around doors and windows.

For various reasons wallpaper borders are typically packaged for sale wrapped around generally rectangular cardboard holders, or cards, unlike regular size wallpaper which is typically packaged in a roll. The holders are essentially flat spools, having a section around which the wallpaper border is wrapped. Typically, a holder and the wallpaper wrapped thereon are suspended vertically, such as from a peg-board display, at the point of sale. Consequently, it is necessary that a ledge or tab be provided along the bottom of the holder to prevent the wallpaper from sliding off the lower end of the holder. See, for example, commonly assigned U.S. Pat. No. Des. 327,427 to McCooey.

Unfortunately, when suspended vertically, the existing holders have the tendency to cause an unsightly crease in the wallpaper border at the location where it wraps around both side edges of the holder adjacent each lower end tab. This crease typically becomes permanent and remains visible even after the wallpaper border has been applied to a surface. Often times the crease leads to further damage such as fraying and tearing which may render the wallpaper border unusable.

SUMMARY OF THE INVENTION

It is therefore an object of the present invention to provide a wallpaper display package that can be displayed vertically without causing a crease or other damage in the border material.

This and other objects are provided, according to the present invention, by a card comprising a generally planar body portion of substantially uniform thickness including opposing faces, opposing upper and lower ends, and substantially parallel opposing first and second side edges. The body portion is configured to receive an elongate wallpaper sheet wound about the opposing faces and the first and second side edges. Opposing first and second tabs are positioned on and project from the respective first and second side edges of the body portion lower end. Each of the first and second tabs have an upper portion configured to prevent the wound wallpaper from sliding over the body portion lower end. The opposing first and second tabs are substantially coplanar with the body portion.

Opposing first and second slots are in the first and second side edges adjacent the first and second tab upper portions and open outwardly therefrom. The opposing first and second slots each extend into the body portion between about 0.05 and 0.50 inches. Additionally, the opposing first and second slots each have a height between about 0.10 and 0.50 inches.

The card may also comprise opposing third and fourth upper tabs positioned on and projecting from respective first and second side edges of the body portion upper end. The third and fourth upper tabs are configured to prevent the wound wallpaper from sliding over the body portion upper end.

The body portion and tabs may be formed of a material selected from the group consisting of cardboard, paperboard, paper, and polymeric sheet. The card may also comprise printed indicia on at least one of the body portion opposing faces.

DETAILED DESCRIPTION OF THE DRAWINGS

Figure 1:
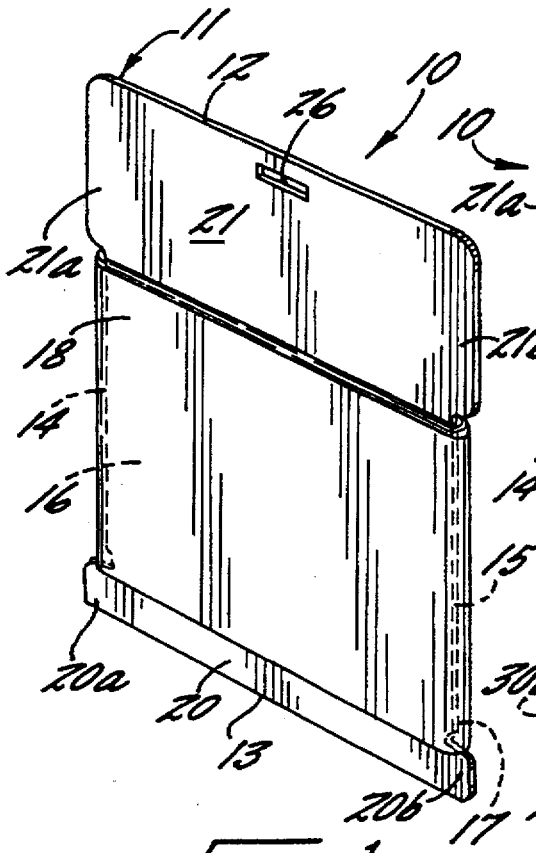
FIG. 1 is a perspective view of a wallpaper holder, according to the present invention.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions may be exaggerated for clarity. Like numbers refer to like elements throughout.

Referring now to FIG. 1, a display package for wallpaper, according to the present invention, is illustrated. The package 10 generally comprises a generally planar card or holder 11 having opposing upper and lower ends 12, 13, generally parallel opposing first and second side edges 14, 15, and opposing faces 16, 17. First and second side edges 14, 15 define a receiving area for the wallpaper border 18 wound around the holder 11. A lower end portion 20, adjacent the lower end 13, comprises a first lower tab **20*a* and a second lower tab 20*b* for preventing the wallpaper border 18 from slipping off the lower end 13 when the holder 11 is displayed in a vertical position. However, as would be known by those having skill in the art, alternative configurations having portions extending from the holder 11 may be utilized to prevent the wallpaper from sliding over the lower end 13**.

Figure 2:
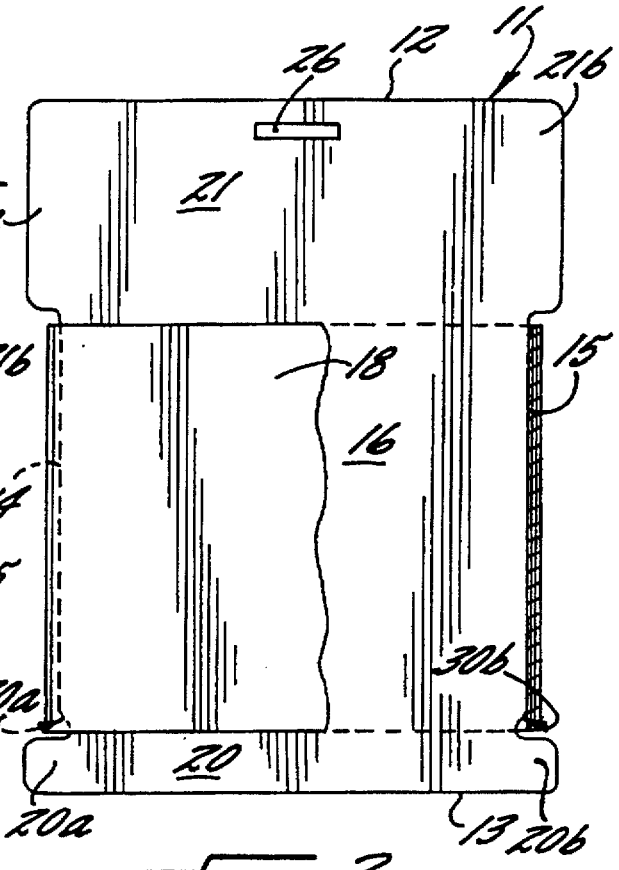
FIG. 2 is a plan view of a wallpaper holder, according to the present invention.

In a preferred embodiment, there is an upper end portion 21, adjacent the upper end 12, comprising a third upper tab **21*a* and a fourth upper tab 21*b* for preventing the wallpaper border 18 from slipping off the upper end 12. As would be understood by those having skill in the art, the holder 11 may be provided without the upper tabs 21*a*, 21*b*. The upper tabs 21*a*, 21*b* may not be necessary if the holder is displayed in the vertical position as illustrated in FIG. 1. The upper and lower tabs 20*a*, 20*b*, 21*a*, 21*b* may have various shapes, and are not limited to the illustrated shape in FIG. 2. Additionally, the holder 11 may have various shapes and is not limited to the shape illustrated in FIG. 2. However, the opposing side edges 14, 15 of the holder 11** should be generally parallel in order to receive wallpaper wound thereon.

The holder 11 preferably has a substantially uniform thickness. Preferred materials include, but are not limited to, cardboard, polymeric sheet, wood, paper, and paperboard.

Preferably an aperture 26 through the upper end portion 21 is provided through which a peg, hook, or other suitable display device can support the holder in the vertical position. The opposing faces 16, 17 typically contain printed indicia for identifying various items such as the brand, type, and style of the wallpaper border. The wallpaper display package 10 is preferably wrapped with a clear sheet of material, such as cellophane, to protect the wallpaper border material from handling and other potential sources of damage that may occur prior to and during the sale of the wallpaper.

Figure 4:
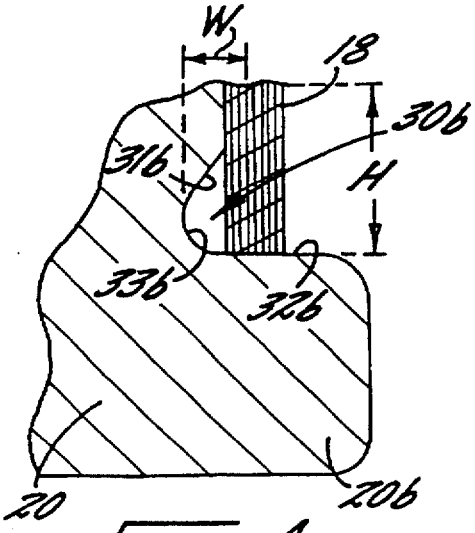
FIG. 4 is an enlarged plan view of one of the slots for preventing damage to wallpaper, according to the present invention.

First and second slots 30*a*, 30*b* open outwardly from respective first and second side edges 14, 15 and are adjacent the first and second lower tabs 20*a*, 20*b*, respectively. As shown in FIG. 4, the first and second slots 30*a*, 30*b* each comprise an upper edge portion 31*a*, 31*b*, a lower edge portion 32*a*, 32*b*, and a medial edge portion 33*a*, 33*b* between the respective upper and lower edge portions. In the illustrated embodiment, the first and second slots 30*a*, 30*b* have an arcuate shape. However, the slots 30*a*, 30*b* may have any shape as long as the minimally acceptable width W and height H are maintained as described below.

Figure 3:
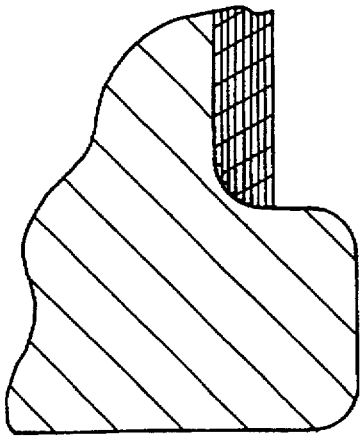
Fig. 3. PRIOR ART
FIG. 3 illustrates a typical prior art wallpaper holder.

FIG. 3 illustrates a typical wallpaper package display in the prior art. No slots are provided in the side edges, and the wallpaper is susceptible to creasing and further damage therefrom, because the inner layers of the wound wallpaper can not fully extend to the tab. Referring now to FIG. 4, when slots 30*a*, 30*b* having the preferred height H and width W are provided, as described below, the wallpaper border 18 is protected from the formation of creases and further damage. All layers of the wound wallpaper 18 can fully extend to the lower edge portions 32*a*, 32*b* of lower tabs 20*a*, 20*b*, as illustrated.

In a preferred embodiment, the width W of each slot 30*a*, 30*b* is between about 0.05 and 0.50 inches. Preferably, the width W of each slot 30*a*, 30*b* is not less than 0.05 inches. However, as those having skill in the art would understand, a slot width W greater than 0.50 inches would be acceptable. Preferably, the height H of each slot 30*a*, 30*b* is between about 0.10 and 0.50 inches. Preferably, the height H of each slot 30*a*, 30*b* is not less than 0.10 inches. However, as those having skill in the art would understand, a slot height H greater than 0.50 inches would be acceptable.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A card for supporting wallpaper wound thereon, comprising:

a generally planar body portion of substantially uniform thickness including opposing faces, opposing upper and lower ends, and substantially parallel opposing first and second side edges, said body portion being configured to receive the wallpaper as it is wound about said opposing faces and said first and second side edges;

opposing first and second tabs positioned on and projecting from respective first and second side edges of said body portion lower end, each of said first and second tabs having an upper portion configured to prevent the wound wallpaper from sliding over said body portion lower end; and opposing first and second slots in said first and second side edges adjacent said first and second tab upper portions and opening outwardly therefrom.

2. A card according to claim 1, wherein said body portion is formed of a material selected from the group consisting of cardboard, paperboard, paper, and polymeric sheet.

3. A card according to claim 1, wherein said first and second tabs are formed of a material selected from the group consisting of cardboard, paperboard, paper, and polymeric sheet.

4. A card according to claim 1, wherein opposing first and second tabs are substantially coplanar with said body portion.

5. A card according to claim 1, further comprising opposing third and fourth upper tabs positioned on and projecting from respective first and second side edges of said body portion upper end, each of said third and fourth upper tabs configured to prevent the wound wallpaper from sliding over said body portion upper end.

6. A wallpaper display package, comprising:

a generally planar body portion of substantially uniform thickness including opposing faces, opposing upper and lower ends, and substantially parallel opposing first and second side edges;

opposing first and second tabs positioned on and projecting from respective first and second side edges of said body portion lower end, each of said first and second tabs having an upper portion;

opposing first and second slots in said first and second side edges adjacent said first and second tab upper portions and opening outwardly therefrom; and an elongate wallpaper sheet wound around said body portion opposing faces and opposing first and second side edges.

7. A wallpaper display package according to claim 6, wherein opposing first and second tabs are substantially coplanar with said body portion.

8. A wallpaper display package according to claim 6, wherein said body portion is formed of a material selected from the group consisting of cardboard, paperboard, paper, and polymeric sheet.

9. A wallpaper display package according to claim 6, wherein said first and second tabs are formed of a material selected from the group consisting of cardboard, paperboard, paper, and polymeric sheet.

10. A wallpaper display package according to claim 6, further comprising opposing third and fourth upper tabs positioned on and projecting from respective first and second side edges of said body portion upper end, each of said third and fourth upper tabs configured to prevent the wound wallpaper from sliding over said body portion upper end.

11. A wallpaper display package, comprising:

a generally planar body portion of substantially uniform thickness including opposing faces, opposing upper and lower ends, and substantially parallel opposing first and second side edges;

opposing first and second tabs positioned on and projecting from respective first and second side edges of said body portion lower end substantially coplanar with said body portion, each of said first and second tabs having an upper portion;

opposing first and second slots in said first and second side edges adjacent said first and second tab upper portions and opening outwardly therefrom;

an elongate wallpaper sheet wound around said body portion opposing faces and opposing first and second side edges; and opposing third and fourth upper tabs positioned on and projecting from respective first and second side edges of said body portion upper end, each of said third and fourth upper tabs configured to prevent the wound wallpaper from sliding over said body portion upper end.

12. A wallpaper display package according to claim 11, wherein said body portion is formed of a material selected from the group consisting of cardboard, paperboard, paper, and polymeric sheet.

13. A wallpaper display package according to claim 11, wherein said first, second, third, and fourth tabs are formed of a material selected from the group consisting of cardboard, paperboard, paper, and polymeric sheet.

* * * * *